US005993259A

United States Patent [19]

Stokoe et al.

[11] Patent Number: 5,993,259

[45] Date of Patent: Nov. 30, 1999

[54] HIGH SPEED, HIGH DENSITY ELECTRICAL CONNECTOR

[75] Inventors: Philip T. Stokoe, Attleboro, Mass.; Thomas Cohen, New Boston; Steven J. Allen, Nashua, both of N.H.

[73] Assignee: Teradyne, Inc., Boston, Mass.

[21] Appl. No.: 08/797,537

[22] Filed: Feb. 7, 1997

[51] Int. Cl.[6] ..... H01R 13/648

[52] U.S. Cl. ..... 439/608; 439/609

[58] Field of Search ..... 439/607–610, 439/59–64, 75, 79

[56] References Cited

U.S. PATENT DOCUMENTS

| | | |
|---|---|---|
| 4,571,014 | 2/1986 | Robin et al. . |
| 4,602,831 | 7/1986 | Lockard . |
| 4,632,476 | 12/1986 | Schell . |
| 4,768,961 | 9/1988 | Lau . |
| 4,806,107 | 2/1989 | Arnold et al. . |
| 4,846,727 | 7/1989 | Glover et al. . |
| 4,975,084 | 12/1990 | Fedder et al. . |
| 4,976,628 | 12/1990 | Fedder . |
| 5,104,341 | 4/1992 | Gilissen et al. . |
| 5,176,538 | 1/1993 | Hansell, III et al. . |
| 5,194,020 | 3/1993 | Voltz . |
| 5,350,319 | 9/1994 | Roberts . |
| 5,388,995 | 2/1995 | Rudy, Jr. et al. . |
| 5,429,521 | 7/1995 | Morlion et al. . |
| 5,433,617 | 7/1995 | Morlion et al. . |
| 5,433,618 | 7/1995 | Morlion et al. . |
| 5,496,183 | 3/1996 | Soes et al. . |
| 5,645,436 | 7/1997 | Shimizu et al. . |
| 5,664,968 | 9/1997 | Mickievicz . |
| 5,672,064 | 9/1997 | Provencher et al. . |
| 5,775,923 | 7/1998 | Tomioka ..... 439/79 |
| 5,795,191 | 8/1998 | Preputnick et al. . |

FOREIGN PATENT DOCUMENTS

| | | |
|---|---|---|
| 0 337 634 | 10/1989 | European Pat. Off. . |
| 0 492 944 | 7/1992 | European Pat. Off. . |
| 0 622 871 | 2/1994 | European Pat. Off. . |
| 0 752 739 | 8/1997 | European Pat. Off. . |
| 195 46 932 | 1/1997 | Germany . |
| 96/38889 | 5/1996 | WIPO . |

*Primary Examiner*—Lincoln Donovan
*Attorney, Agent, or Firm*—Edmund J. Walsh

[57] ABSTRACT

A high speed, high density electrical connector for use with printed circuit boards. The connector is in two pieces with one piece having pins and shield plates and the other having socket type signal contacts and shield plates. The shields have a grounding arrangement which is adapted to control the electromagnetic fields, for various system architectures, simultaneous switching configurations and signal speeds, allowing all of the socket type signal contacts to be used for signal transmission. Additionally, at least one piece of the connector is manufactured from wafers, with each ground plane and signal column injection molded into components which, when combined, form a wafer. This construction allows very close spacing between adjacent columns of signal contacts as well as tightly controlled spacing between the signal contacts and the shields. It also allows for easy and flexible manufacture, such as a connector that has wafers intermixed in a configuration to accommodate single ended, point to point and differential applications.

23 Claims, 11 Drawing Sheets

HIGH SPEED, HIGH DENSITY ELECTRICAL CONNECTOR

This invention relates generally to electrical connectors used to interconnect printed circuit boards and more specifically to such connectors designed to carry many high speed signals.

Electrical connectors are used in many electronic systems. It is generally easier and more cost effective to manufacture a system on several printed circuit boards which are then joined together with electrical connectors. A traditional arrangement for joining several printed circuit boards is to have one printed circuit board serve as a backplane. Other printed circuit boards, called daughter boards, are connected through the backplane.

A traditional backplane is a printed circuit board with many connectors. Conducting traces in the printed circuit board connect to signal pins in the connectors so that signals may be routed between the connectors. Other printed circuit boards, called "daughter boards" also contain connectors that are plugged into the connectors on the backplane. In this way, signals are routed among the daughter boards through the backplane. The daughter cards often plug into the backplane at a right angle. The connectors used for these applications contain a right angle bend and are often called "right angle connectors."

Connectors are also used in other configurations for interconnecting printed circuit boards, and even for connecting cables to printed circuit boards. Sometimes, one or more small printed circuit boards are connected to another larger printed circuit board. The larger printed circuit board is called a "mother board" and the printed circuit boards plugged into it are called daughter boards. Also, boards of the same size are sometimes aligned in parallel. Connectors used in these applications are sometimes called "stacking connectors" or "mezzanine connectors."

Regardless of the exact application, electrical connector designs have generally needed to mirror trends in the electronics industry. Electronic systems generally have gotten smaller and faster. They also handle much more data than systems built just a few years ago. These trends mean that electrical connectors must carry more and faster data signals in a smaller space without degrading the signal.

Connectors can be made to carry more signals in less space by placing the signal contacts in the connector closer together. Such connectors are called "high density connectors." The difficulty with placing signal contacts closer together is that there is electromagnetic coupling between the signal contacts. As the signal contacts are placed closer together, the electromagnetic coupling increases. Electromagnetic coupling also increases as the speed of the signals increase.

In a conductor, the amount of electromagnetic coupling is indicated by measuring the "cross talk" of the connector. Cross talk is generally measured by placing a signal on one or more signal contacts and measuring the amount of signal coupled to another signal contact. The choice of which signal contacts are used for the cross talk measurement as well as the connections to the other signal contacts will influence the numerical value of the cross talk measurement. However, any reliable measure of cross talk should show that the cross talk increases as the speed of the signals increases and also as the signal contacts are placed closer together.

A traditional method of reducing cross talk is to ground signal pins within the field of signal pins. The disadvantage of this approach is that it reduces the effective signal density of the density of the connector.

To make both a high speed and high density connector, connector designers have inserted shield members between signal contacts. The shields reduce the electromagnetic coupling between signal contacts, thus countering the effect of closer spacing or higher frequency signals. Shielding, if appropriately configured, can also control the impedance of the signal paths through the connector, which can also improve the integrity of signals carried by the connector.

An early use of shielding is shown in Japanese patent disclosure 49-6543 by Fujitsu, Ltd. dated Feb. 15, 1974. U.S. Pat. Nos. 4,632,476 and 4,806,107—both assigned to AT&T Bell Laboratories—show connector designs in which shields are used between columns of signal contacts. These patents describe connectors in which the shields run parallel to the signal contacts through both the daughter board and the backplane connectors. Cantilevered beams are used to make electrical contact between the shield and the backplane connectors. U.S. Pat. Nos. 5,433,617; 5,429,521; 5,429,520 and 5,433,618—all assigned to Framatome Connectors International—show a similar arrangement. The electrical connection between the backplane and shield is, however, made with a spring type contact.

Other connectors have the shield plate within only the daughter card connector. Examples of such connector designs can be found in U.S. Pat. Nos. 4,846,727; 4,975,084; 5,496,183; 5,066,236—all assigned to AMP, Inc. An other connector with shields only within the daughter board connector is shown in U.S. Pat. No. 5,484,310, assigned to Teradyne, Inc.

From the number of patents that describe connectors using shielding to reduce cross talk, it will be appreciated that the placement and connection of the shields can have a great effect on the electrical performance of the connector. The specific configuration of the shielding can also have a significant impact on the mechanical properties of the connector. For example, the manner in which the electrical connection is made to the shield can influence whether there is "stubbing" when the connectors are mated. Stubbing means that one contact gets caught on another contact. When there is stubbing, one of the contacts is usually damaged, requiring that the connector be repaired or replaced.

It would be highly desirable to have a shield arrangement that is highly effective at reducing the cross talk between signal contacts. It would be also highly desirable if the shielding arrangement were mechanically robust. It would also be desirable if that connector were easy to manufacture. It would further be highly desirable to control signal reflections by controlling the geometry of the shields and signal contacts for impedance matching the connection.

SUMMARY OF THE INVENTION

With the foregoing background in mind, it is an object of the invention to provide a high speed, high density connector.

It is a further object to provide a high performance connector that allows all of its signal contacts to be used for carrying signals.

It is also an object to provide an electrical connector that is mechanically robust.

It is a further object to provide a connector that is easy to manufacture.

The foregoing and other objects are achieved in an electrical connector having shield plates between rows of signal contacts in both the daughter board and backplane connectors. The shield plates in the backplane connector have torsional contacts. The torsional contacts significantly reduce the chance of stubbing. They also provide a highly desirable pattern of current flow through the shields, which increases their effectiveness at reducing inductive coupling between signal contacts and the resulting cross talk.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
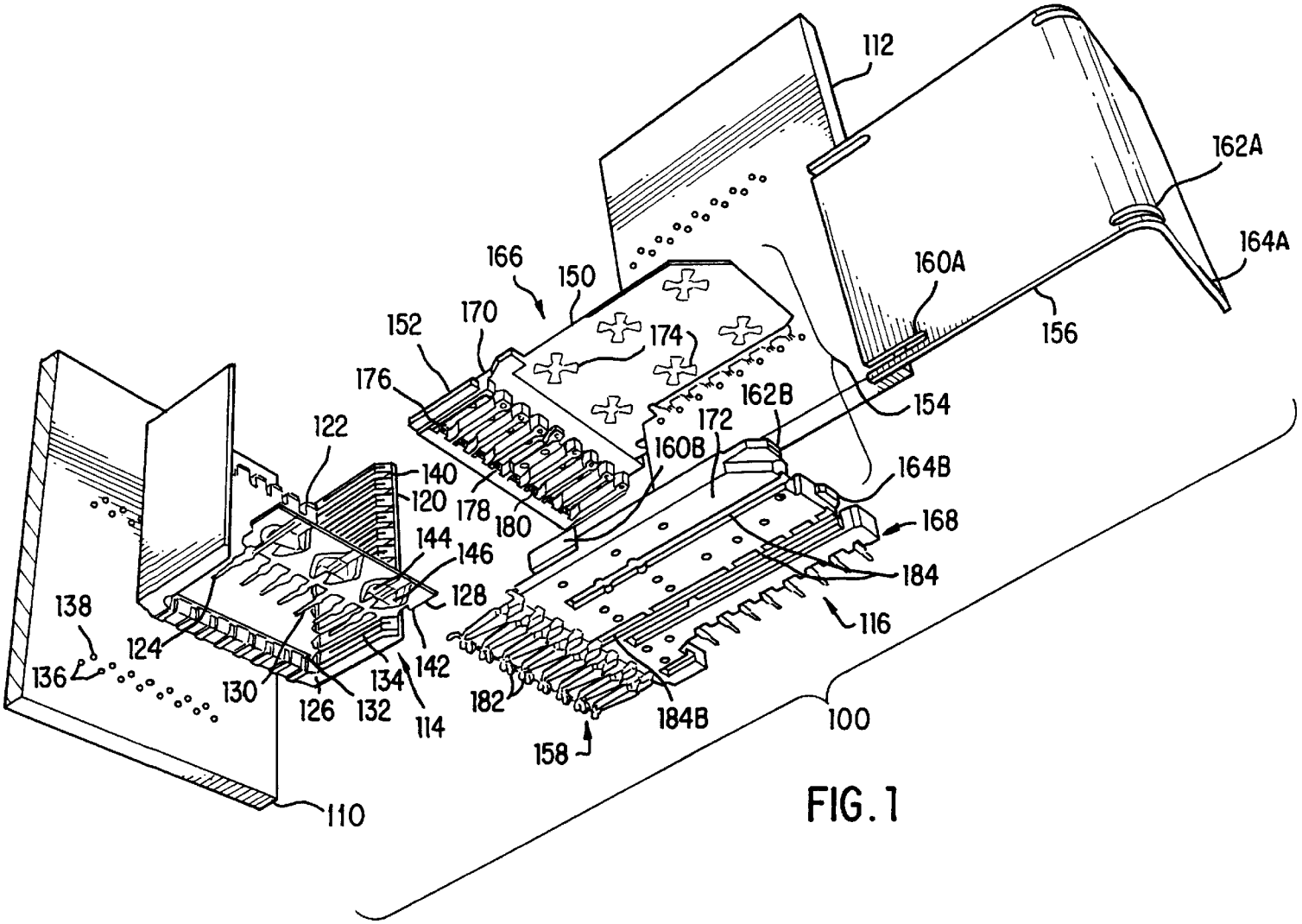
FIG. 1 is an exploded view of a connector made in accordance with the invention.

FIG. 1 shows an exploded view of backplane assembly 100. Backplane 110 has pin header 114 attached to it. Daughter card 112 has daughter card connector 116 attached to it. Daughter card connector 116 can be mated to pin header 114 to form a connector. Backplane assembly likely has many other pin headers attached to it so that multiple daughter cards can be connected to it. Additionally, multiple pin headers might be aligned end to end so that multiple pin headers are used to connect to one daughter card. However, for clarity, only a portion of backplane assembly and a single daughter card 112 are shown.

Pin header 114 is formed from shroud 120. Shroud 120 is preferably injection molded from a plastic, polyester or other suitable insulative material. Shroud 120 serves as the base for pin header 114.

The floor (not numbered) of shroud 120 contains columns of holes 126. Pins 122 are inserted into holes 126 with their tails 124 extending through the lower surface of shroud 120. Tails 124 are pressed into signal holes 136. Holes 136 are plated through-holes in backplane 110 and serve to electrically connect pins 122 to traces (not shown) on backplane 110. For clarity of illustration, only a single pin 122 is shown. However, pin header 114 contains many parallel columns of pins. In a preferred embodiment, there are eight rows of pins in each column.

The spacing between each column of pins is not critical. However, it is one object of the invention to allow the pins to be placed close together so that a high density connector can be formed. By way of example, the pins within each column can be spaced apart by 2.25 mm and the columns of pins can be spaced apart by 2 mm. Pins 122 could be stamped from 0.4 mm thick copper alloy.

Shroud 120 contains a groove 132 formed in its floor that runs parallel to the column of holes 126. Shroud 120 also has grooves 134 formed in its sidewalls. Shield plate 128 fits into grooves 132 and 134. Tails 130 protrude through holes (not visible) in the bottom of groove 132. Tails 130 engage ground holes 138 in backplane 110. Ground holes 138 are plated through-holes that connect to ground traces on backplane 110.

In the illustrated embodiment, plate 128 has seven tails 130. Each tail 130 falls between two adjacent pins 122. It would be desirable for shield 128 to have a tail 130 as close as possible to each pin 122. However, centering the tails 130 between adjacent signal pins 122 allows the spacing between shield 128 and a column of signal pins 122 to be reduced.

Shield plate 128 has several torsional beams contacts 142 formed therein. Each contact 142 is formed by stamping arms 144 and 146 in plate 128. Arms 144 and 146 are then bent out of the plane plate 128. Arms 144 and 146 are long enough that they will flex when pressed back into the plane of plate 128. Arms 144 and 148 are sufficiently resilient to provide a spring force when pressed back into the plane of plate 128. The spring force generated by arms 144 and 146 creates a point of contact between each arm 144 or 146 and plate 150. The generated spring force must be sufficient to ensure this contact even after the daughter card connector 116 has been repeatedly mated and unmated from pin header 114.

During manufacture, arms 144 and 146 are coined. Coining reduces the thickness of the material and increases the compliancy of the beams without weakening of plate 128.

For enhanced electrical performance, it is desirable that arms 144 and 146 be as short and straight as possible. Therefore, they are made only as long as needed to provide the required spring force. In addition, for electrical performance, it is desirable that there be one arm 144 or 146 as close as possible to each signal pin 122. Ideally, there would be one arm 144 and 146 for each signal pin 122. For the illustrated embodiment with eight signal pins 122 per column, there would ideally be eight arms 144 or 146, making a total of four balanced torsional beam contacts 142. However, only three balanced torsional beam contacts 142 are shown. This configuration represents a compromise between the required spring force and desired electrical properties.

Grooves 140 on shroud 120 are for aligning daughter card connector 116 with pin header 114. Tabs 152 fit into grooves 140 for alignment and to prevent side to side motion of daughter card connector 116 relative to pin header 114.

Daughter card connector 116 is made of wafers 154. Only one wafer 154 is shown for clarity, but daughter card connector 116 has, in a preferred embodiment, several wafers stacked side to side. Each wafer 154 contains one column of receptacles 158. Each receptacle 158 engages one pin 122 when the pin header 114 and daughter card connector 116 are mated. Thus, daughter card connector 116 is made from as many wafers as there are columns of pins in pin header 114.

Wafers 154 are supported in stiffener 156. Stiffener 156 is preferably stamped and formed from a metal strip. It is stamped with features to hold wafer 154 in a required position without rotation and therefore preferably includes three attachment points. Stiffener 156 has slot 160A formed along its front edge. Tab 160B fits into slot 160A. Stiffener 156 also includes holes 162A and 164A. Hubs 162B and 164B fit into holes 162A and 164A. The hubs 162B and 164B are sized to provide an interference fit in holes 162A and 164A.

FIG. 1 shows only a few of the slots 160A and holes 162A and 164A for clarity. The pattern of slots and holes is repeated along the length of stiffener 156 at each point where a wafer 156 is to be attached.

Figure 4:
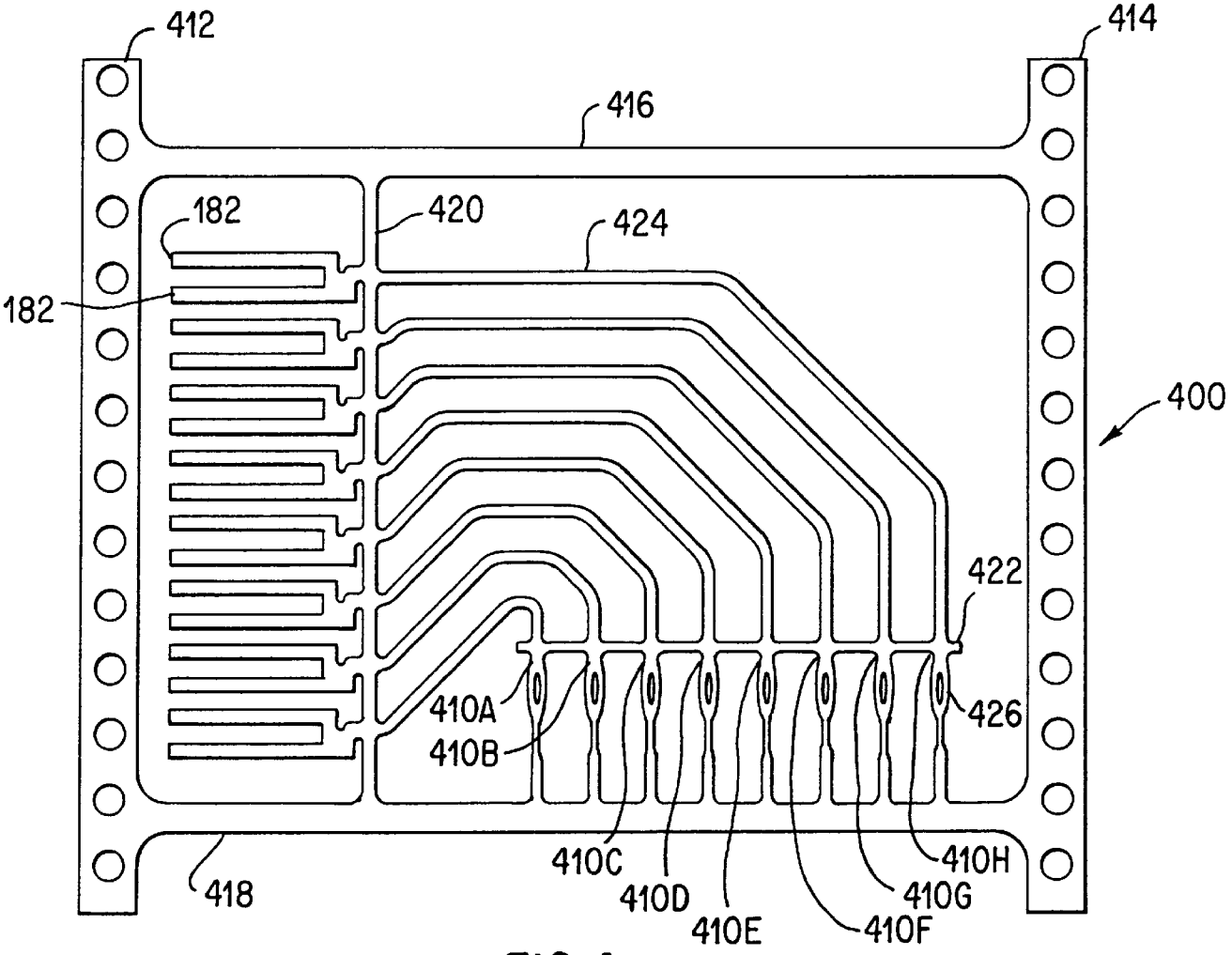
FIG. 4 is a signal contact blank used in the connector of FIG. 1.

In the illustrated embodiment, wafer 154 is made in two pieces, shield piece 166 and signal piece 168. Shield piece 166 is formed by insert molding housing 170 around the front portion of shield 150. Signal piece 168 is made by insert molding housing 172 around contacts 410A . . . 410H (FIG. 4).

Signal piece 168 and shield piece 166 have features which hold the two pieces together. Signal piece 168 has hubs 512 (FIG. 5) formed on one surface. The hubs align with and are inserted into clips 174 cut into shield 150. Clips 174 engage hubs 512 and hold plate 150 firmly against signal piece 168.

Housing 170 has cavities 176 formed in it. Each cavity 176 is shaped to receive one of the receptacles 158. Each cavity 176 has platform 178 at its bottom. Platform 178 has a hole 180 formed through it. Hole 180 receives a pin 122 when daughter card connector 116 mates with pin header 114. Thus, pins 122 mate with receptacles 158, providing a signal path through the connector.

Receptacles 158 are formed with two legs 182. Legs 182 fit on opposite sides of platform 178 when receptacles 158 are inserted into cavities 176. Receptacles 158 are formed such that the spacing between legs 182 is smaller than the width of platform 178. To insert receptacles 158 into cavity 176, it is therefore necessary to use a tool to spread legs 182.

The receptacles form what is known as a preloaded contact. Preloaded contacts have traditionally been formed by pressing the receptacle against a pyramid shaped platform. The apex of the platform spreads the legs as the receptacle is pushed down on it. Such a contact has a lower insertion force and is less likely to stub on the pin when the two connectors are mated. The receptacles of the invention provide the same advantages, but are achieved by inserting the receptacles from the side rather than by pressing them against a pyramid.

Housing 172 has grooves 184 formed in it. As described above, hubs 512 (FIG. 5) project through plate 150. When two wafers are stacked side by side, hubs 512 from one wafer 154 will project into grooves 184 of an adjacent wafer. Hubs 512 and grooves 184 help hold adjacent wafers together and prevent rotation of one wafer with respect to the next. These features, in conjunction with stiffener 156 obviate the need for a separate box or housing to hold the wafers, thereby simplifying the connector.

Housings 170 and 172 are shown with numerous holes (not numbered) in them. These holes are not critical to the invention. They are "pinch holes" used to hold plates 150 or receptacle contacts 410 during injection molding. It is desirable to hold these pieces during injection molding to maintain uniform spacing between the plates and receptacle contacts in the finished product.

Figure 2:
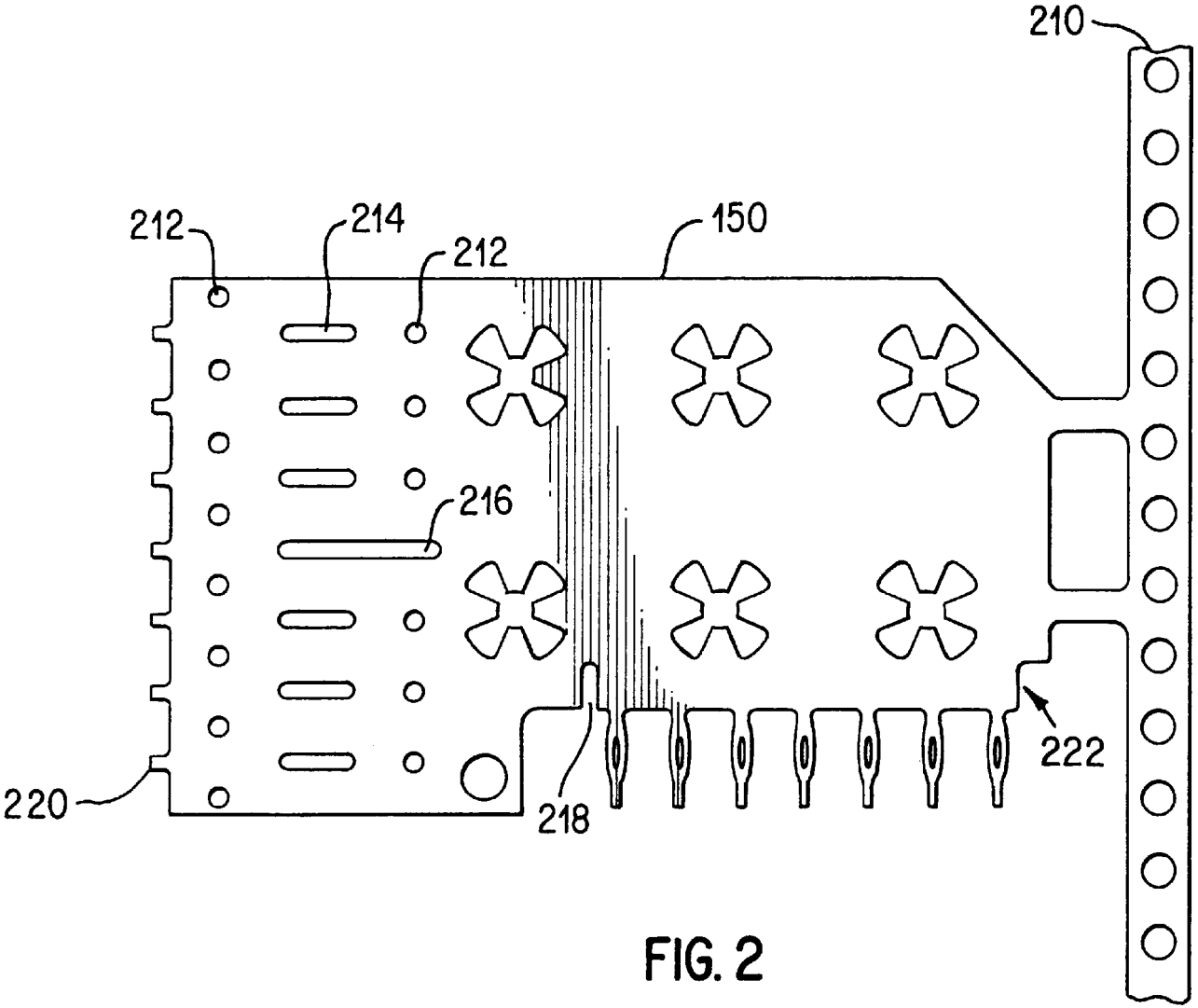
FIG. 2 is a shield plate blank used in the connector of FIG. 1.

FIG. 2 shows in greater detail the blank used to make plate 150. In a preferred embodiment, plates 150 are stamped from a roll of metal. The plates are retained on carrier strip 210 for ease of handling. After plate 150 is injection molded into a shield piece 166, the carrier strip can be cut off.

Plates 150 include holes 212. Holes 212 are filled with plastic from housing 170, thereby locking plate 150 in housing 170.

Plates 150 also include slots 214. Slots 214 are positioned to fall between receptacles 158. Slots 214 serve to control the capacitance of plate 150, which can overall raise or lower the impedance of the connector. They also channel current flow in the plate near receptacles 158, which are the signal paths. Higher return current flow near the signal paths reduces cross talk.

Slot 216 is similar to the slots 214, but is larger to allow a finger 316 (FIG. 3) to pass through plate 150 when plate 150 is molded into a housing 170. Finger 316 is a small finger of insulating material that could aid in holding a plate 128 against plate 150. Finger 316 is optional and could be omitted. Note in FIG. 1 that the central two cavities 176 have their intermediate wall partially removed. Finger 316 from an adjacent wafer 154 (not shown) would fit into this space to complete the wall between the two central cavities. Finger 316 would extend beyond housing 170 and would fit into a slot 184B of an adjacent wafer (not shown).

Figure 9A:
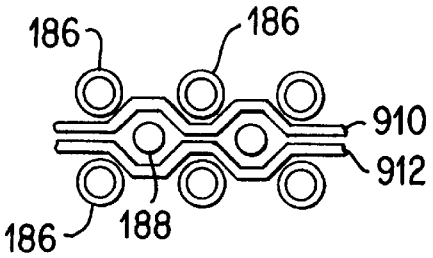
FIG. 9A and 9B are backplane hole and signal trace patterns for single ended and differential embodiments of the invention, respectively.
Figure 9B:
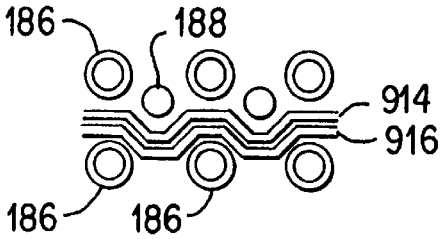

Slot 218 allows tail region 222 to be bent out of the plane of plate 150, if desired. FIG. 9A shows traces 910 and 912 on a printed circuit board routed between holes used to mount a connector according to the invention. FIG. 9A shows portions of a column of signal holes 186 and portions of a column of ground contacts 188. When the connector is used to carry single ended signals, it is desirable that the traces 910 and 912 be separated by ground to the greatest extent possible. Thus, it is desirable that the ground holes 188 be centered between the column of signal holes 186 so that the signal traces 910 and 912 can be routed between the signal holes 186 and ground holes 188. On the other hand, FIG. 9B shows the preferred routing for differential pair signals. For differential pair signals, it is desirable that the traces be routed as close together as possible. To allow the traces 914 and 916 to be close together, the ground holes 188 are not centered between columns of signal holes 186. Rather, they are offset to be as close to one row of signal contacts 186. That placement allows both signal traces 914 and 916 to be routed between the ground holes 188 and a column of signal holes 186. In the single ended configuration, tail region 222 is bent out of the plane of plate 150. For the differential configuration, it is not bent.

It should also be noted that plate 128 (FIG. 1) can be similarly bent in its tail region, if desired. In the preferred embodiment, though, plate 128 is not bent for single ended signals and is bent for differential signals.

Tabs 220 are bent out of the plane of plate 150 prior to injection molding of the housing 170. Tabs 220 will wind up between holes 180 (FIG. 1). Tabs 220 aid in assuring that plate 150 adheres to housing 170. They also reinforce housing 170 across its face, i.e. that surface facing pin header 114.

Figure 3:
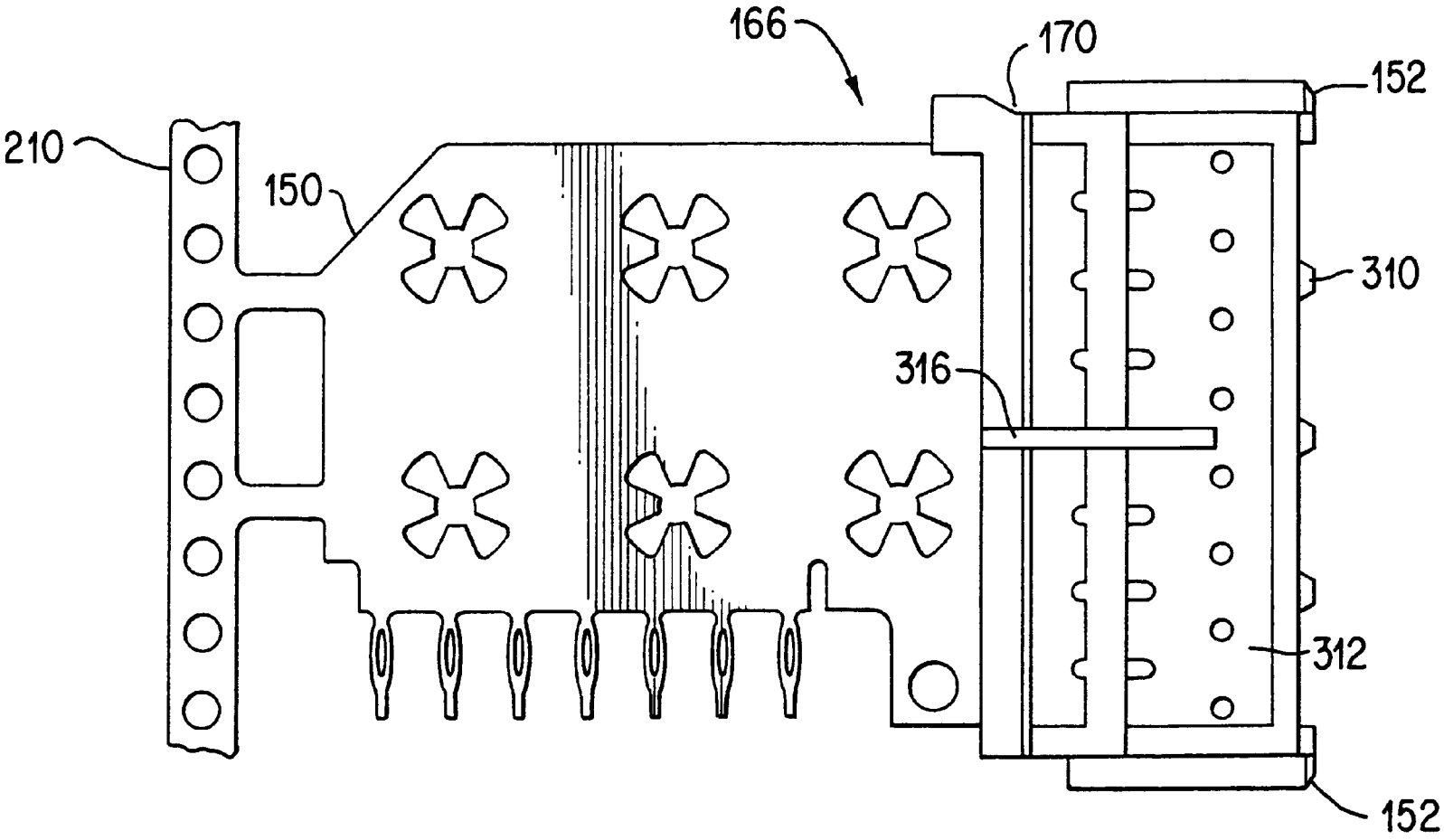
FIG. 3 is a view of the shield plate blank of FIG. 2 after it is insert molded into a housing element.

FIG. 3 shows shield 150 after it has been insert molded into housing 170 to form ground portion 166. FIG. 3 shows that housing 170 includes pyramid shaped projections 310 on the face of shield piece 166. Matching recesses (not shown) are included in the floor of pin header 114. Projections 310 and the matching recesses serve to prevent the spring force of torsional beam contacts 142 from spreading adjacent wafers 154 when daughter card connector 116 is inserted into pin header 114.

FIG. 4 shows receptacle contact blank 400. Receptacle contact blank is preferably stamped from a sheet of metal. Numerous such blanks are stamped in a roll. In the preferred embodiment, there are eight receptacle contacts 410A . . . 410H. The receptacle contacts 410 are held together on carrier strips 412, 414, 416, 418 and 422. These carrier strips are severed to separate contacts 410A . . . 410H after housing 172 has been molded around the contacts. The carrier strips can be retained during much of the manufacturing operation for easy handling of receptacle portions 168.

Each of the receptacle contacts 410A . . . 410H includes two legs 182. The legs 182 are folded and bent to form the receptacle 158.

Each receptacle contact 410A . . . 410H also includes a transmission region 424 and a tail region 426. FIG. 4 shows that the transmission regions 424 are equally spaced. This arrangement is preferred for single ended signals as it results in maximum spacing between the contacts.

FIG. 4 shows that the tail regions are suitable for being press fit into plated through-holes. Other types of tail regions might be used. For example, solder tails might be used instead.

Figure 5:
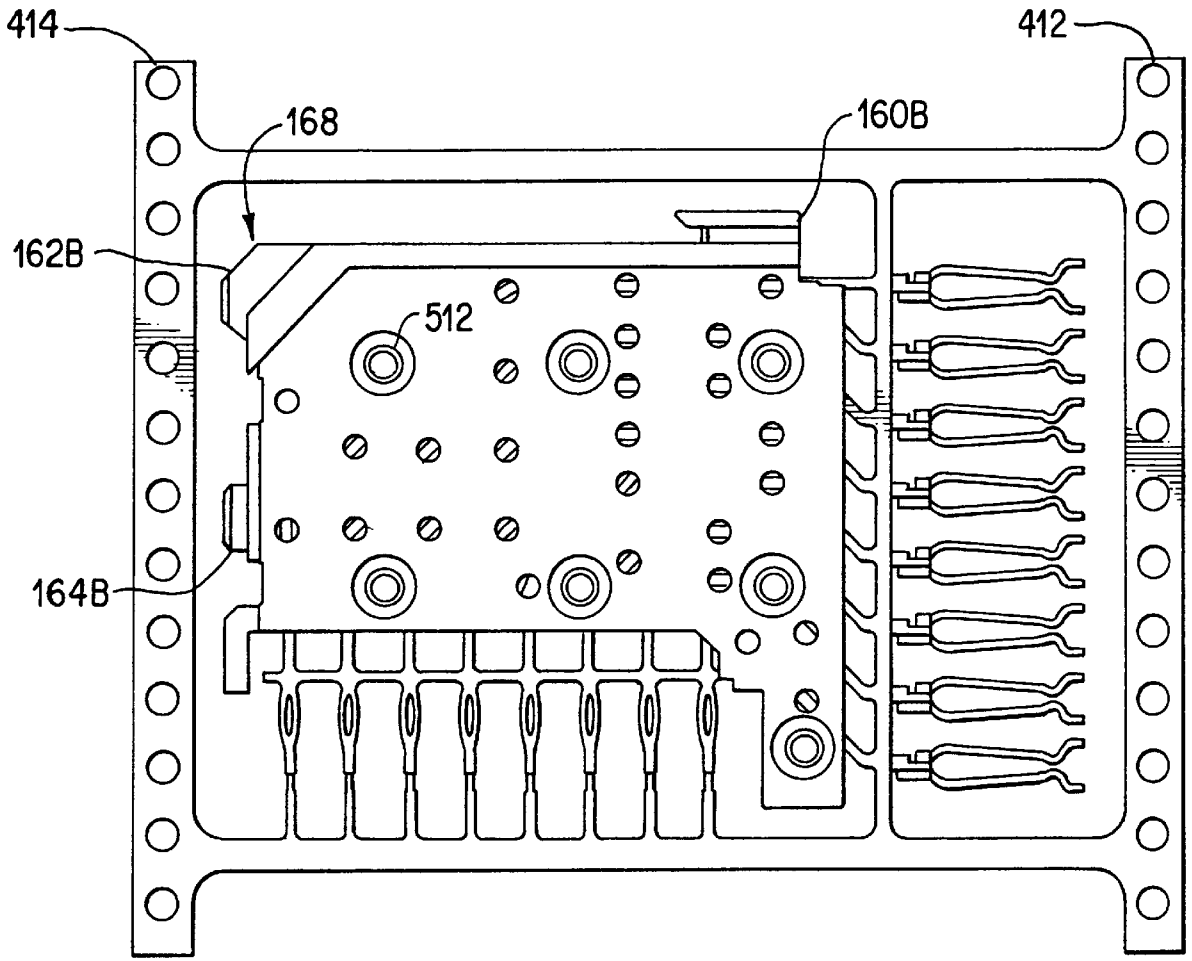
FIG. 5 is a view of the signal contact blank of FIG. 4 after it is insert molded into a housing element.

FIG. 5 shows receptacle contact blank 400 after housing 172 has been molded around it.

Figure 6:
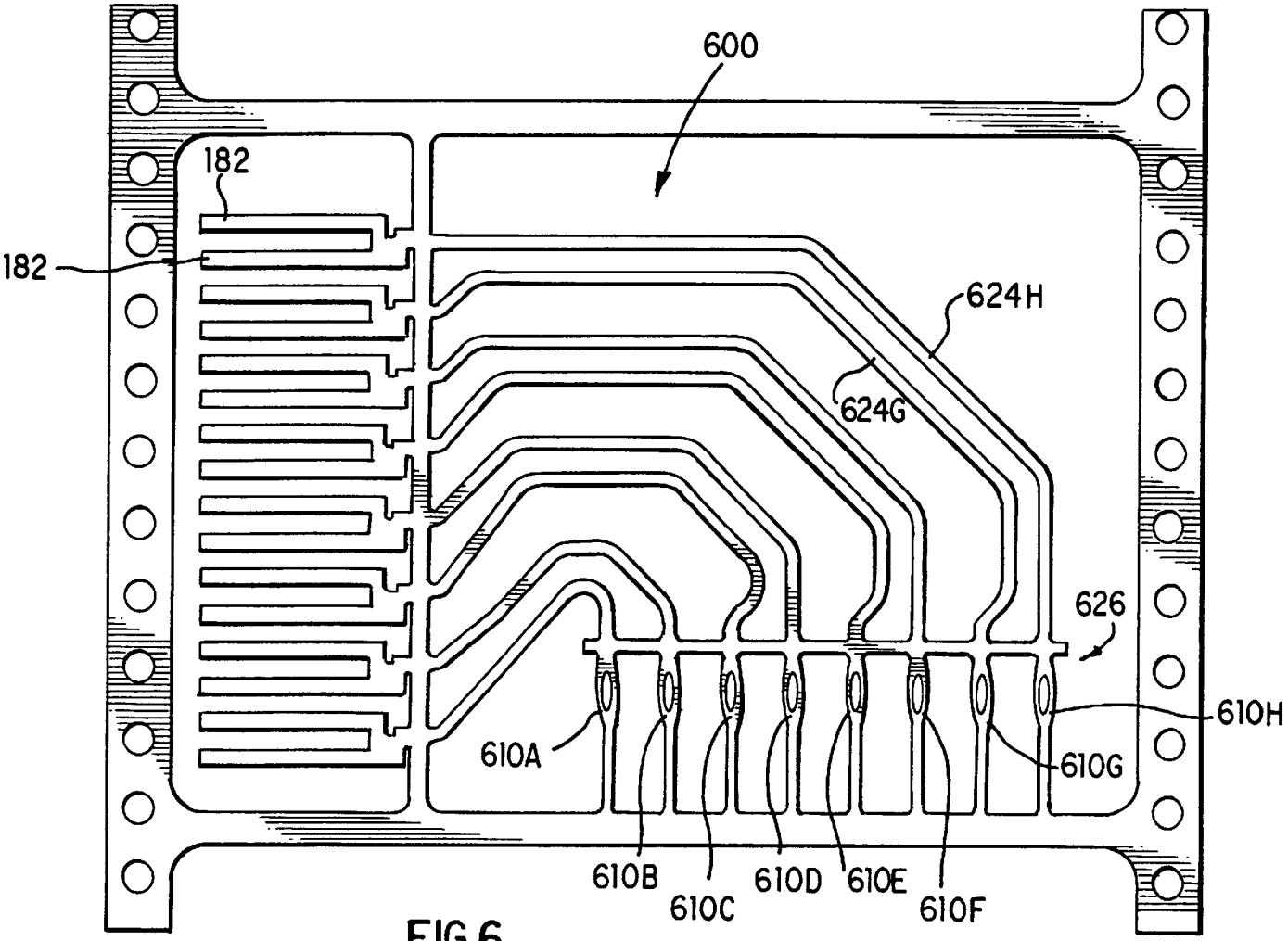
FIG. 6 is an alternative embodiment of the signal contact blank of FIG. 4 suitable for use in making a differential module.

FIG. 6 shows a receptacle contact blank 600 suitable for use in an alternative embodiment of the invention. Receptacle contacts 610A . . . 610H are grouped in pairs: (610A and 610B), (610C and 610D), (610E and 610F) and (610G and 610H). Transmission regions 624 of each pair are as close together as possible while maintaining differential impedance. This increases the spacing between adjacent pairs. This configuration improves the signal integrity for differential signals.

The tail region 626 and the receptacles of receptacle contact blank 400 and 600 are identical. These are the only portions of receptacle contacts 410 and 610 extending from housing 172. Thus, externally, signal portion 168 is the same for either single ended or differential signals. This allows single ended and differential signal wafers to be mixed in a single daughter card connector.

Figures 7A, 7B, 7C:
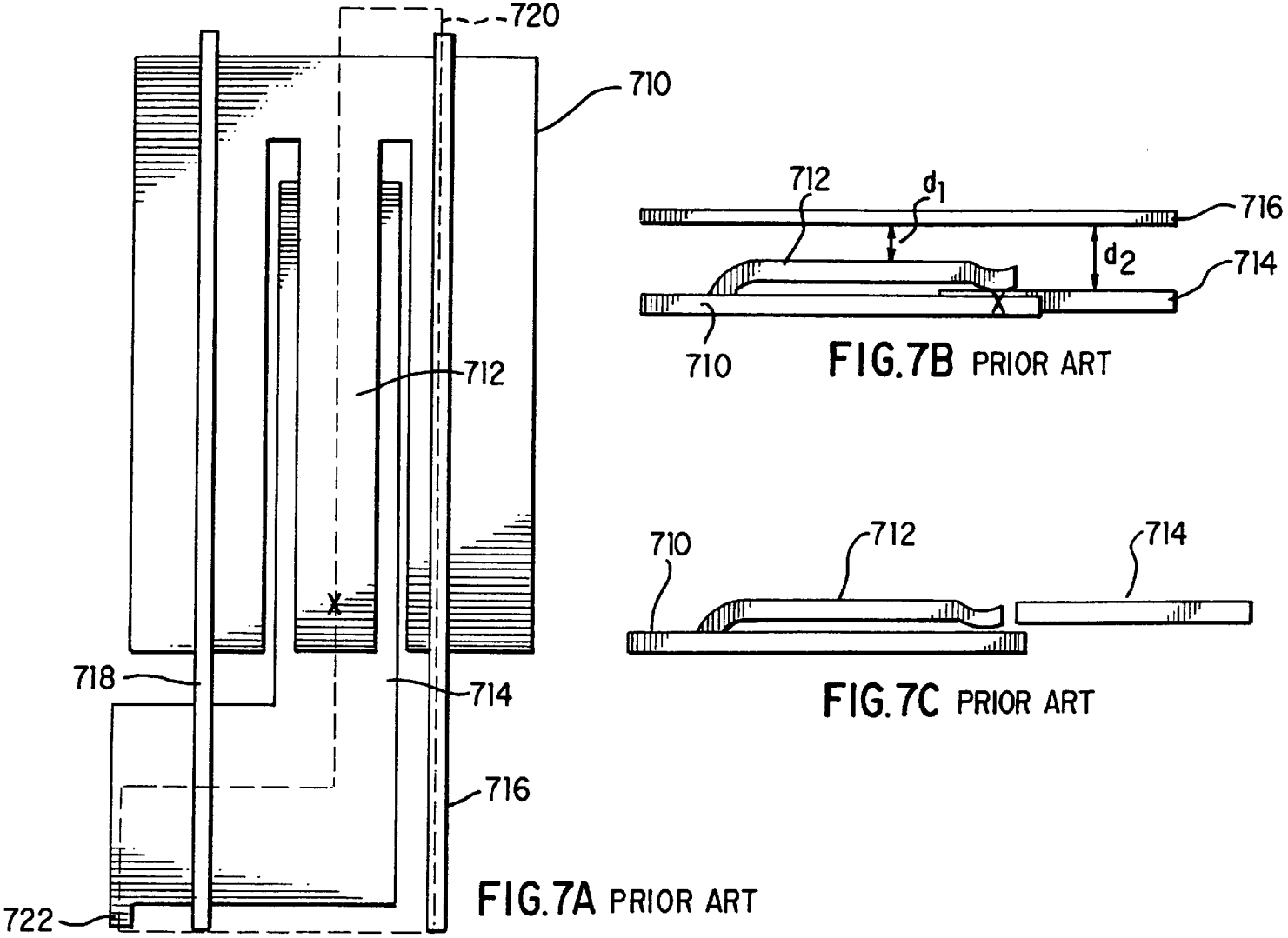
FIG.7B PRIOR ART
FIG.7C PRIOR ART
FIG.7A PRIOR ART
FIGS. 7A–7C are operational views a prior art connector.

FIG. 7A illustrates a prior art connector as an aid in explaining the improved performance of the invention. FIG. 7A shows a shield plate 710 with a cantilevered beam 712 formed in it. The cantilevered beam 712 engages a blade 714 from the pin header. The point of contact is labeled X. Blade 714 is connected to a backplane (not shown) at point 722.

Signals are transmitted through signal pins 716 and 718 running adjacent to the shield plate. Plate 710 and blade 714 act as the signal return. The signal path 720 through these elements is shown as a loop. It should be noted that signal path 720 cuts through pin 718. As is well known, a signal traveling in a loop passing through a conductor will inductively couple to the conductor. Thus, the arrangement of FIG. 7A will have relatively high coupling or cross talk from pin 716 to 718.

FIG. 7B shows a side view of the arrangement of FIG. 7A. As the cantilevered beam 712 is above the blade 714 its distance from pin 716 is $d_1$. In contrast, blade 714 has a spacing of $d_2$, which is larger. In the transmission of high frequency signals, the distance between the signal path and the ground dictates the impedance of the signal path. Changes in distance mean changes in impedance. Changes in impedance cause signal reflections, which is undesirable.

FIG. 7C shows the same arrangement upon mating. The blade 714 must slide under cantilevered beam 712. If not inserted correctly, blade 714 can but up against the end of cantilevered beam 712. This phenomenon is called "stubbing." It is highly undesirable in a connector because it can break the connector.

Figure 8A:
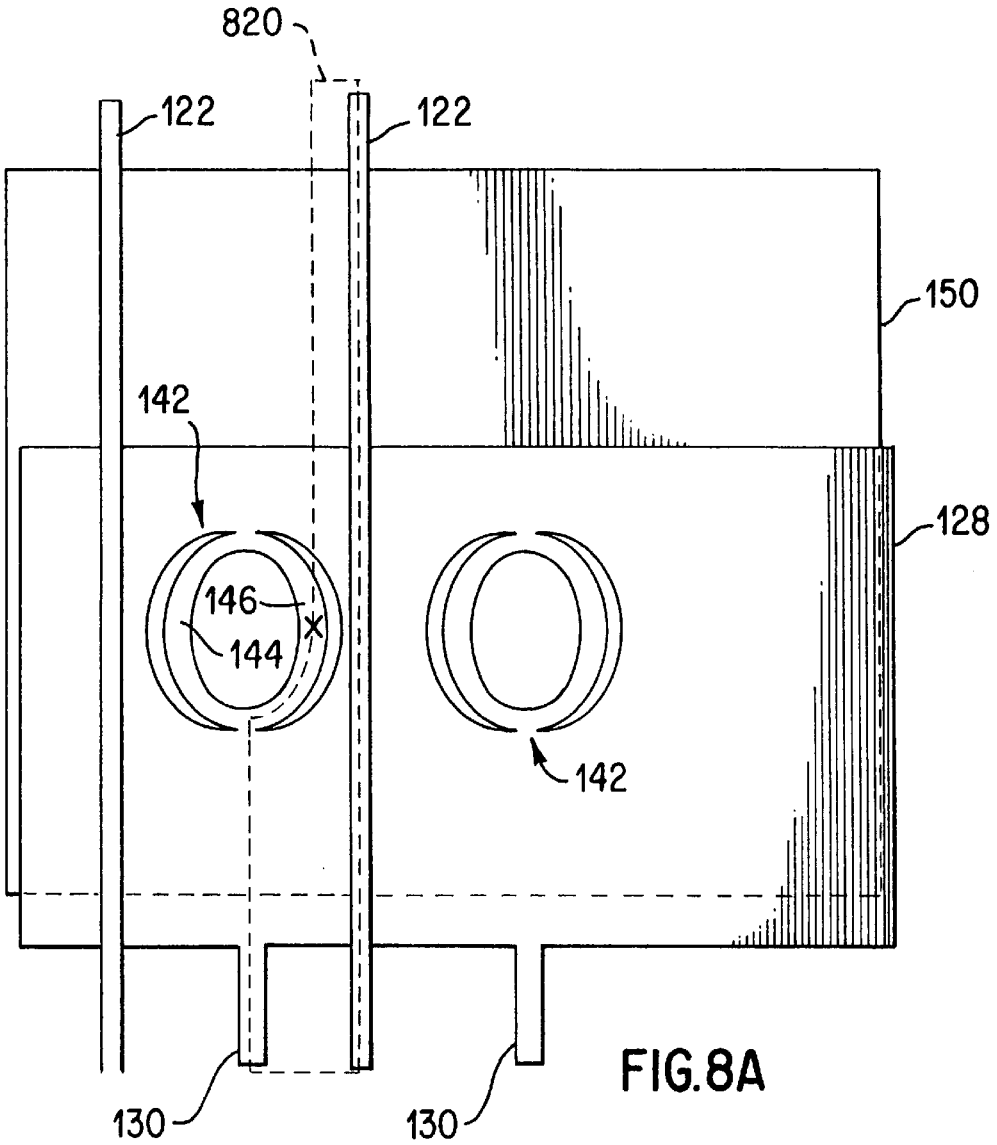
FIGS. 8A–8C are similar operational views of the connector of FIG. 1.

In contrast, FIG. 8 shows in a schematic sense the components of a connector manufactured according to the invention. Shield plates 128 and 150 overlap. Contact is made at the point marked X on torsional beam 146. Signal path 820 is shown to pass through a signal pin 122, return through plate 150 to point of contact X, pass through arm 146, through plate 128 and through tail 130. Signal path 820 is then completed through the backplane (not shown in FIG. 8). Significantly, signal path 820 does not cut through any adjacent signal pin 122. In this way, cross talk is significantly reduced over the prior art.

Figure 8B:
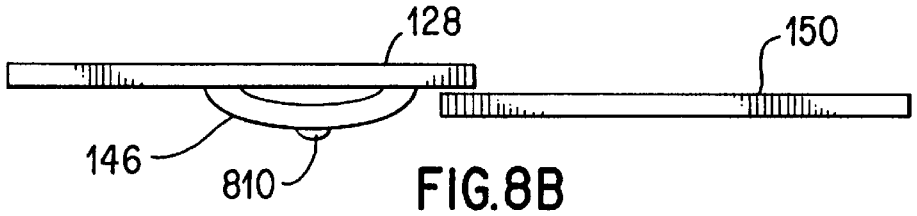

FIG. 8B illustrates schematically plates 128 and 150 prior to mating of daughter card connector 116 to pin header 114. In the perspective of FIG. 8B, arm 146 is shown bent out of the plane of plate 128. As plates 150 and 128 slide along one another during mating, arm 146 is pressed back into the plane of plate 128.

Figure 8C:
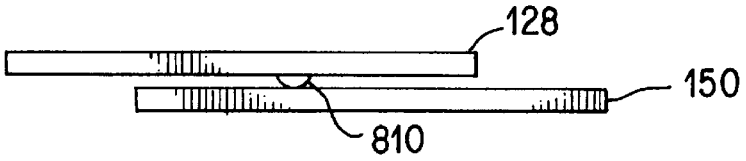

FIG. 8C show plates 128 and 150 in the mated configuration. Dimple 810 pressed into arm 146 is shown touching plate 150. The torsional spring force generated by pressing arm 146 back into the plane of plate 128 ensures a good electrical contact. It should be noted that the spacing between the plates 128 or 150 and an adjacent signal contact do not have as large a discontinuity as shown in FIG. 7B. This improvement should improve the electrical performance of the connector.

It should also be noted that in moving from the configuration of FIG. 8B to FIG. 8C, there is not an abrupt surface that could lead to stubbing. Thus, with torsional contacts, the mechanical robustness of the connector should be improved in comparison to the prior art.

Figure 10:
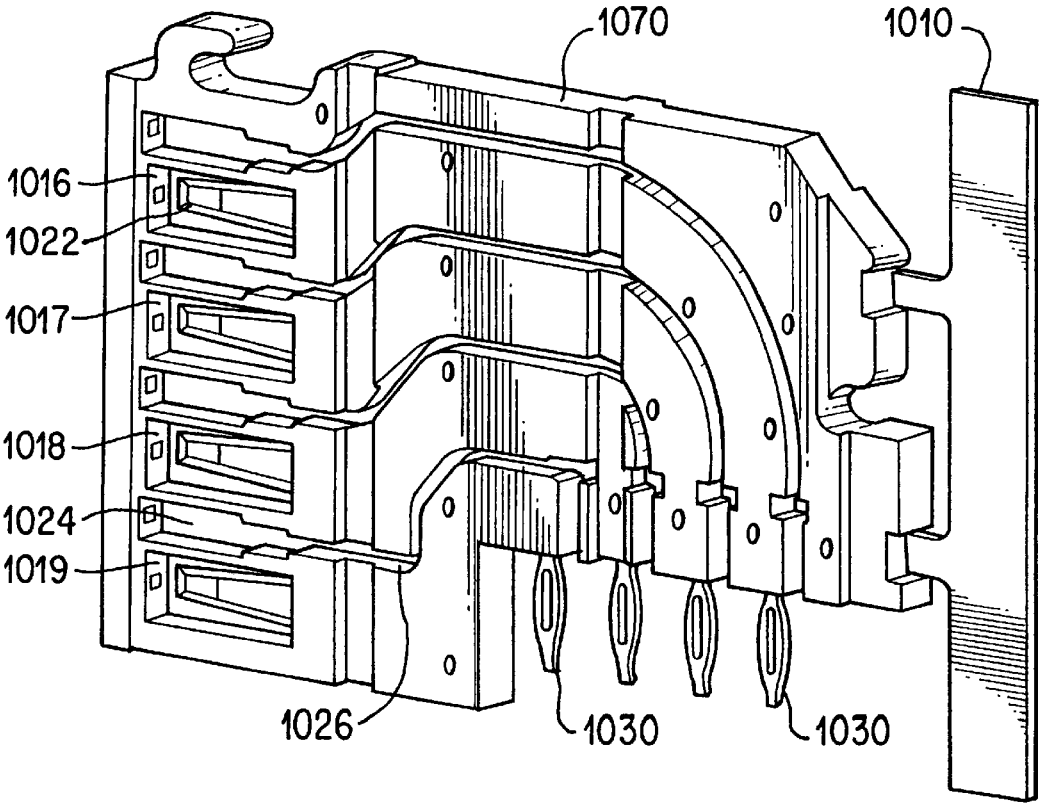
FIG. 10 is a view of an alternative embodiment of the invention.

FIG. 10 shows an alternative embodiment of a wafer 154 (FIG. 1). In the embodiment of FIG. 10, a shield blank on carrier strip 1010 is encapsulated in an insulative housing 1070 through injection molding. Shield tails 1030 are shown extending from housing 1070. Housing 1070 includes cavities 1016, 1017, 1018 and 1019. The shield blank is cut and bent to make contacts 1020 within cavities 1016, 1017, 1018 and 1019.

Cavities 1016, 1017, 1018 and 1019 have holes 1022 formed in their floors. Pins from the pin header are inserted through the holes during mating and engage, through the springiness of the pin as well as of contacts 1020 ensure electrical connection to the shield.

In the embodiment of FIG. 10, the signal contacts are stamped separately. The transmission line section of the contacts are laid into cavities 1026. The receptacle portions of the signal contacts are inserted into cavities 1024.

A wafer as in FIG. 10 illustrates that any number of signal contacts might be used per column. In FIG. 10, four signal contacts per column are shown. That figure also illustrates that pins might be used in place of a plate 128. However, there might be differences in electrical performance. A plate could be used in conjunction with the configuration of FIG. 10. In that case, instead of a series of separate holes 1022 in cavities 1016, 1017, 1018 and 1019, a slot would be cut through the cavities.

Figure 11A:
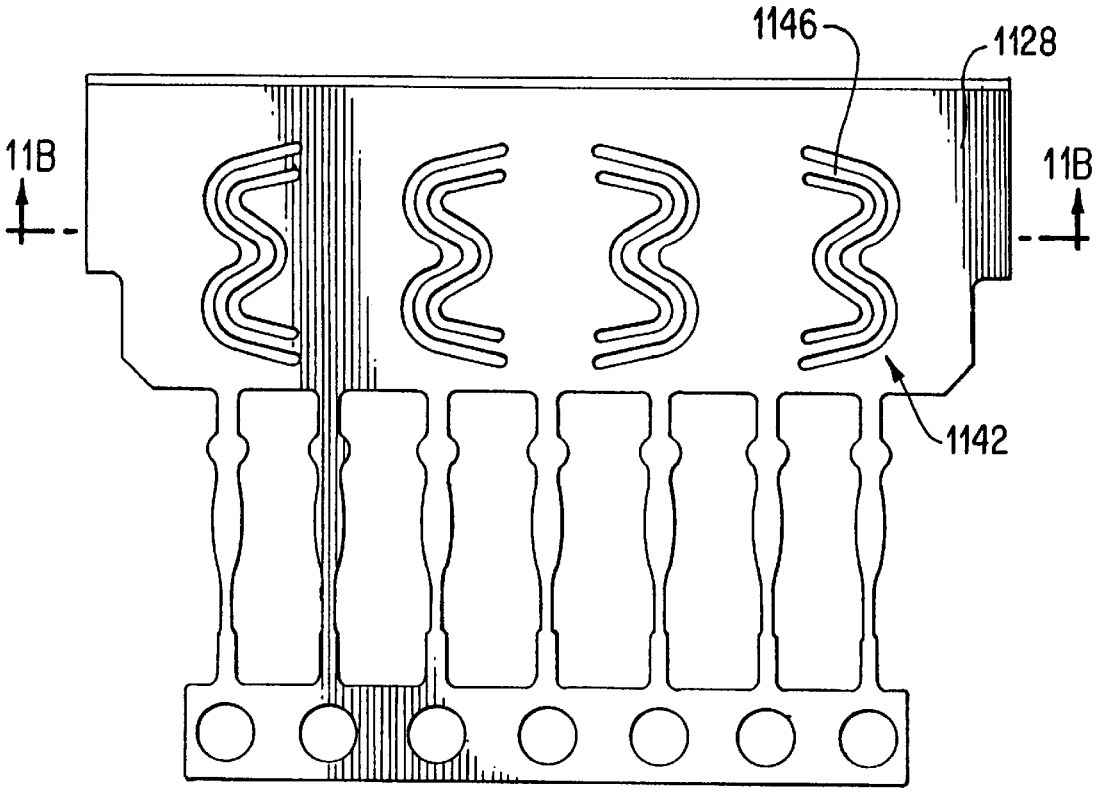
FIG. 11A is a an alternative embodiment for the plate 128 in FIG. 1.

FIG. 11A shows an alternative embodiment for contacts 142 on plate 128. Plate 1128 includes a series of torsional contacts 142. Each contact is made by stamping an arm 1146 from plate 1128. Here the arms have a generally serpentine shape. As described above, it is desirable for the arms 146 to be long enough to provide good flexibility. However, it is also desirable for the current to flow through the contacts 1142 in an area that is as narrow as possible in a direction perpendicular to the flow of current through signal pins 122.

To achieve both of these goals, arms 1146 are stamped in a serpentine shape.

Figure 11B:
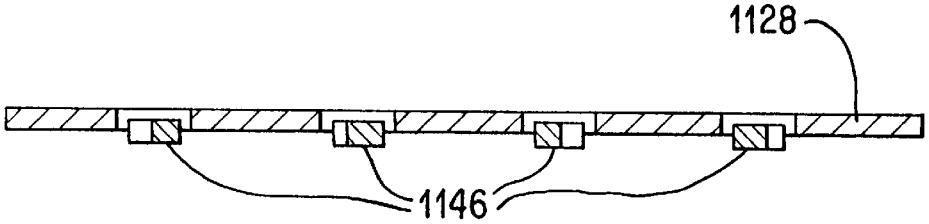
FIG. 11B is a cross sectional view taken through the line B—B of FIG. 11A.

FIG. 11B shows plate 1128 in cross section through the line indicated as B—B in FIG. 1A. As shown, arms 1146 are bent out of the plane of plate 1128. During mating of the connector half, they are pressed back into the plane of plate 1128, thereby generating a torsional force.

Figure 12:
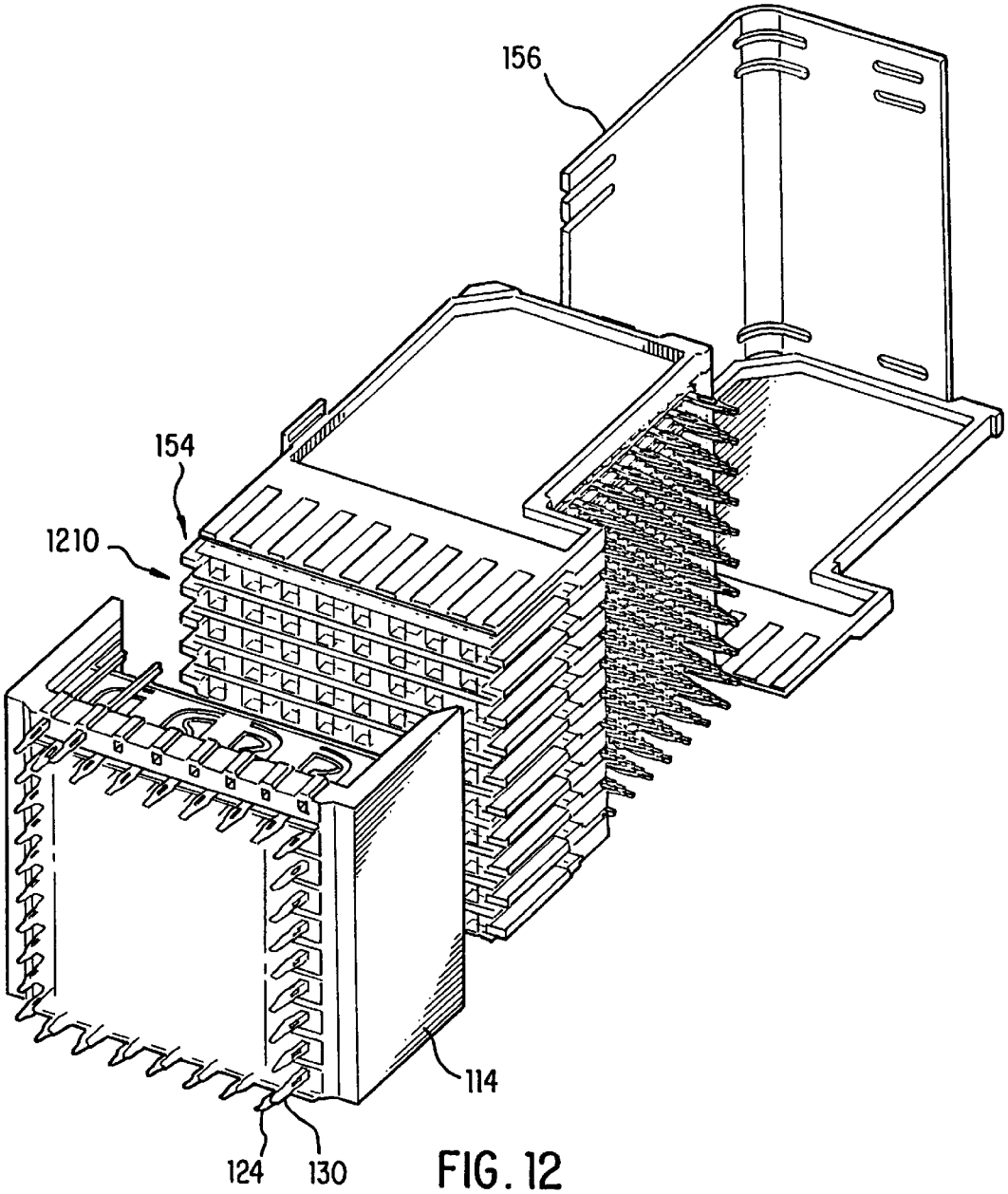
FIG. 12 is an isometric view of a connector according to the invention.

FIG. 12 shows an additional view of connector 100. FIG. 12 shows face 1210 of daughter card connector 116. The lower surface of pin header 114 is also visible. In this view, it can be seen that the press fit tails 124 of plate 128 have an orientation that is at right angles to the orientation of press fit tails 130 of signal pins 122.

EXAMPLE

A connector made according to the invention was made and tested. The test was made with the single ended configuration and measurements were made on one signal line with the ten closest lines driven. For signal rise times of 500 ps, the backward crosstalk was 4.9%. The forward cross talk was 3.2%. The reflection was too small to measure. The connector provided a real signal density of 101 per linear inch.

Having described one embodiment, numerous alternative embodiments or variations might be made. For example, the size of the connector could be increased or decreased from what is shown. Also, it is possible that materials other than those expressly mentioned could be used to construct the connector.

Various changes might be made to the specific structures. For example, clips 174 are shown generally to be radially symmetrical. It might improve the effectiveness of the shield plate 150 if clips 174 were elongated with a major axis running parallel with the signal contacts in signal pieces 168 and a perpendicular minor axis which is as short as possible.

Also, manufacturing techniques might be varied. For example, it is described that daughter card connector 116 is formed by organizing a plurality of wafers onto a stiffener. It might be possible that an equivalent structure might be formed by inserting a plurality of shield pieces and signal receptacles into a molded housing.

Therefore, the invention should be limited only by the spirit and scope of the appended claims.

What is claimed is:

1. An electrical connector comprising:

a) a pin header comprising:

i) an insulative base;

ii) a plurality of columns of pins attached to the insulative based;

iii) a first plurality of conducting plates attached to the insulative base, each conducting plate disposed between an adjacent column of pins and each conducting plate having formed therein a plurality of torsional contacts;

b) a mating connector piece comprising:

i) an insulative base shaped to mate with the insulative base of the pin header;

ii) a plurality of columns of receptacles, each column having a plurality of receptacles disposed to engage one of the plurality of pins;

iii) a second plurality of conducting plates, each conducting plate disposed between an adjacent column of receptacles and being disposed to engage the plurality of torsional contacts on one of the plurality of conducting plates in the pin header.

2. The electrical connector of claim 1 wherein a) each of the plurality of columns of pins includes a first number of pins; and b) each of the first plurality of conducting plates in the pin header has a second number of contact tails extending therefrom, said second number being equal to or greater than the first number minus one.

3. The electrical connector of claim 1 wherein each of the torsional contacts comprises at least one arm stamped from one of the first plurality of conducting plates, the arm being connected to the plate at two points and bent out of the plane of the plate.

4. The electrical connector of claim 1 wherein each of the torsional contacts comprises an arm stamped out of one of the first plurality of conducting plates, the arm having a thickness less than the thickness of the conducting plate.

5. The electrical connector of claim 1 wherein adjacent receptacles within the same column are spaced apart by an amount less than or equal to 2 mm and adjacent columns of receptacles are spaced apart by an amount less than or equal to 2.25 mm.

6. The electrical connector of claim 1 wherein each of the torsional contacts contains an arm and the arm has a serpentine shape.

7. The electrical connector of claim 1 wherein the daughter card connector comprises a plurality of modules, the connector additionally comprising a metal stiffener to which each of the plurality of modules is attached.

8. An electrical connector incorporated into a back plane assembly with a backplane and at least one daughter card, the electrical connector comprising:

a) a first connector piece having:

i) a plurality of pin shaped signal contacts, each signal contact having a tail portion attached to the backplane, the pin shaped signal contacts being disposed in a plurality of parallel columns;

ii) a first plurality of shield plates, each shield plate being disposed between adjacent columns of signal contacts and each having a plurality of tail portions extending therefrom and attached to the backplane, each tail portion of each shield plate being disposed between tails portions of adjacent signal contacts within the same column of signal contacts, wherein, for each shield plate, there is one tail portion between each pair of adjacent signal contacts in an adjacent column of signal contacts;

b) a second connector piece having:

i) a plurality of receptacle signal contacts, the plurality of receptacle signal contacts being disposed in a plurality of parallel columns with each receptacle disposed to engage a pin shaped signal contact;

ii) a second plurality of shield plates, each shield plate being disposed between adjacent columns of receptacle signal contacts, wherein each of the second plurality of shield plates mechanically engages one of the first plurality of shield plates with contact arms attached to one of the first or second plurality of shield plates at two points.

9. The electrical connector of claim 8 wherein each column of signal contacts has at least six signal contacts.

10. The electrical connector of claim 8 additionally comprising a means for providing a return current path for any given pin shaped signal contact does not cross any other pin shaped signal contact, wherein said means includes the first plurality of shield plates and the second plurality of shield plates.

11. The electrical connector of claim 8 wherein the tail portions of the signal contacts and the tail portions of the plates are press fit tails and the tail portions of the signal contacts are at right angles to the tail portions of the plates.

12. The electrical connector of claim 8 wherein a portion of the first plurality of plates has a slot cut therein and the plate has a bend along a line perpendicular to the slot, with the portion of the plate on one side of the bend forming a tail region and the portion of the plate on the other side of the bend forming a shield region, with the tail region and the shield region being parallel and the tail portions being connected to the tail region of the plate.

13. The electrical connector of claim 8 wherein the tail portions of the first plurality of plates are grounded in the backplane.

14. An electrical connector with a first connector piece having a plurality of columns of signal contacts and a second connector piece having columns of signal contacts adapted to mate to the signal contacts when the first connector piece and the second connector piece are mated, CHARACTERIZED IN THAT the connector further comprises:

a) a first plurality of shield plates, each disposed between adjacent rows of signal contacts in the first connector piece;

b) a second plurality of shield plates, each disposed between adjacent rows of signal contacts in the second connector piece; and c) a plurality of contacts on the first plurality or second plurality of shield plates, and wherein when the first connector piece and the second connector piece are mated, each of the first plurality of plates is parallel to and makes contact with one of the second plurality of plates at a plurality of points.

15. The electrical connector of claim 14 wherein the first connector piece comprises a pin header having a plurality of rows of signal pins mounted in a shroud having two side walls with slots formed therein and the first plurality of shield plates engage the slots on the side walls.

16. The electrical connector of claim 15 wherein each of the plurality of contacts on the first plurality or second plurality of shield plates comprises an arm attached to the plate at two points and bent out of the plane of the plate.

17. The electrical connector of claim 16 wherein there are a plurality of arms across the width of the plate.

18. The electrical connector according to claim 14 wherein each of the signal contacts has a tail (and each of the shield plates has a plurality of tails disposed between adjacent signal contact tails.

19. An electrical connector according to claim 14 wherein the second connector piece comprises a plurality of wafers aligned in parallel with each of the second plurality of shields accessible from a side of one of the wafers, the wafers being positioned such that, when the first connector piece and the second connector piece are mated, the first plurality of shields fit between adjacent wafers to make contact with one of the second plurality of shields.

20. An electrical connector according to any of claim 14 additionally comprising:

a) a stiffener;

b) a plurality of wafers, each of the wafers having a front face facing the first connector piece and a rear portion attached to the stiffener, thereby leaving slots between the front faces of adjacent wafers, wherein the first plurality of shield plates are inserted into the slots.

21. An electrical connector according to claim 19 wherein each of the wafers includes one column of signal contacts secured in an housing.

22. The electrical connector according to claim 14 wherein the signal contacts in the second connector piece comprise receptacle contacts.

23. An electrical connector according to claim 14 wherein the first connector piece is attached to a backplane and the second connector piece is attached to a daughter card.

* * * * *